United States Patent [19]

Utter

[11] Patent Number: 4,655,696

[45] Date of Patent: Apr. 7, 1987

[54] ANTI-ROTATION COUPLING FOR A SCROLL MACHINE

[75] Inventor: Robert E. Utter, Genoa, Wis.

[73] Assignee: American Standard Inc., New York, N.Y.

[21] Appl. No.: 797,733

[22] Filed: Nov. 14, 1985

[51] Int. Cl.[4] ..... F01C 1/04; F16D 3/04

[52] U.S. Cl. ..... 418/55; 29/156.4 R; 464/102

[58] Field of Search ..... 418/55; 464/102; 29/156.4 R

[56] References Cited

U.S. PATENT DOCUMENTS

| | | | |
|---|---|---|---|
| 1,769,107 | 7/1930 | Brown | 464/102 |
| 3,884,599 | 5/1975 | Young et al. | 418/55 |
| 3,924,977 | 12/1975 | McCullough | 418/55 |
| 4,065,279 | 12/1977 | McCullough | 418/55 |
| 4,325,683 | 4/1982 | Miyazawa | 418/55 |

FOREIGN PATENT DOCUMENTS

| | | | |
|---|---|---|---|
| 54-139107 | 10/1979 | Japan | 418/55 |
| 58-30404 | 2/1983 | Japan | 418/55 |
| 58-47101 | 3/1983 | Japan | 464/102 |
| 58-104386 | 6/1983 | Japan | 29/156.4 R |

*Primary Examiner*—John J. Vrablik

*Attorney, Agent, or Firm*—Ronald M. Anderson; William J. Beres; Robert J. Harter

[57] ABSTRACT

This invention is an improved "Oldham coupling" for use in a scroll machine to prevent angular rotation of one of the scroll members relative to the other. The coupling is of simplified one-piece construction that can be stamped from sheet metal in a single operation. The preferred embodiment is an oval-shaped stamped ring having four tabs extending from its perimeter at 90° intervals. Two of the tabs, at opposite sides of the ring, slidingly engage slots in one of the orbiting scroll members while the other two tabs slidingly engage slots disposed either in the stationary frame of the scroll machine or in the other scroll member.

20 Claims, 5 Drawing Figures

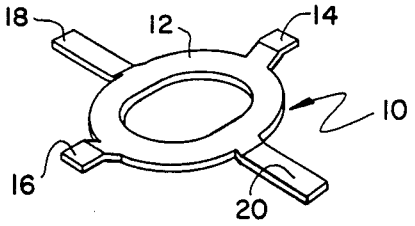
FIG. 3
FIG. 4
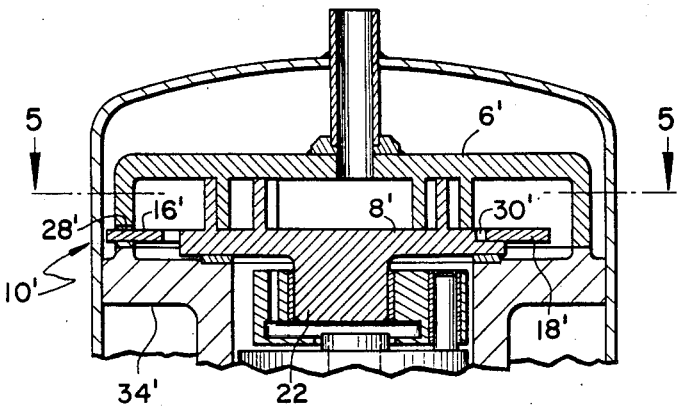
FIG. 5
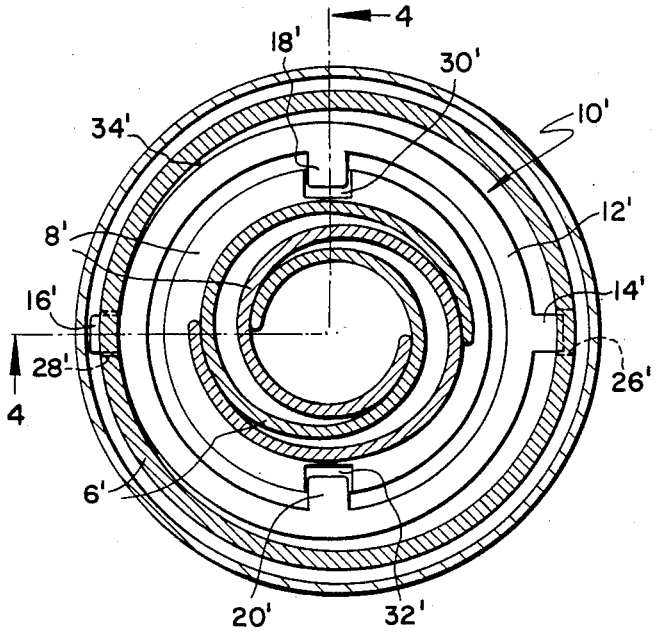

ANTI-ROTATION COUPLING FOR A SCROLL MACHINE

TECHNICAL FIELD

This invention generally pertains to anti-rotation couplings used in scroll machines, and specifically to "Oldham couplings."

BACKGROUND ART

Fluid displacement apparatus of the scroll type typically include two parallel plates, eachhaving an involute wrap element disposed on one side. These involute elements, having offset and parallel axes, intermesh with each other such that the sides of the involutes and the parallel plates define sealed fluid pockets.

As one involute orbits the other, the fluid pockets move from an inlet port, along the flank surfaces of the involute wrap elements, and through an outlet port. Depending on the configuration of the involutes and their direction of orbital rotation, the volume of these moving pockets will either increase, decrease, or remain relatively constant. Thus, a scroll machine may function as an expander (vacuum pump), a compressor, or a liquid pump, respectively.

If one involute element were free to rotate with respect to the other, some of the fluid pocket seals would leak and the intermeshed involutes would bind together.Therefore, to prevent this it is necessary to have an anti-rotation coupling that maintains a fixed angular relationship between the involutes yet still allows one to orbit the other.

Designs for such couplings are well known in the prior art. For example, U.S. Pat. No. 3,924,977 discloses a conventional "Oldham coupling" comprising an annular ring with four sliding keys disposed at 90° intervals around its perimeter. Two of the keys, at opposite sides of the ring engae slots in the orbiting element while the other two engage slots in the stationary portion of the machine. Although this coupling is effective, its bulk requires substantial space within the scroll machine and it is somewhat costly to manufacture.

Therefore, it is an object of this invention to provide a simple anti-rotation coupling that requires minimal space in a scroll machine.

It is a further object to provide an anti-rotation coupling that is less expensive to manufacture than conventional coupling designs.

It is yet a further object of this invention to produce an anti-rotaton coupling from an integral sheet metal stamping.

These and other objects will be apparent from the attached drawngs and the description of the preferred embodiments that follow below.

DISCLOSURE OF THE INVENTION

The subject invention is an improved coupling for maintaining a fixed angular relationship betwen two parallel scroll plates within a scroll machine. Both scroll plates include an involute wrap element that intermeshes with the other wrap element.

The coupling, comprising a generally annular ring blanked as a unitary piece from sheet metal, includes a plurality of tabs disposed around its periphery. These tabs extend in a radial direction at spaced apart intervals around the ring with at least one tab slidingly engaging at least one slot disposed in the orbiting scroll plate, and with at least one other tab generally perpendicular to the first slidingly engaging at least one slot in a stationary portion of the scroll machine.

The tabs, being free to slide within the slots, allow one scroll plae to be driven in an orbital path relative to the other while constraining it in a fixed rotational relationship. This coupling means requires minimal space within the scroll machine because the coupling is a relatively thin item that can be easily blanked from sheet metal in a single operation.

BRIEF DESCRIPTION OF THE DRAWINGS

FIG. 3 shows an isometric view of the improved coupling.

FIG. 4 shows a cutaway view of the scroll machien with the improved coupling disposed between the scroll plates as described in the second embodiment.

FIG. 5 shows a top cutaway view of the scroll machine with the coupling disposed around the scroll elements as described in the second embodiment.

DESCRIPTION OF THE PREFERRED EMBODIMENT

Figure 1:
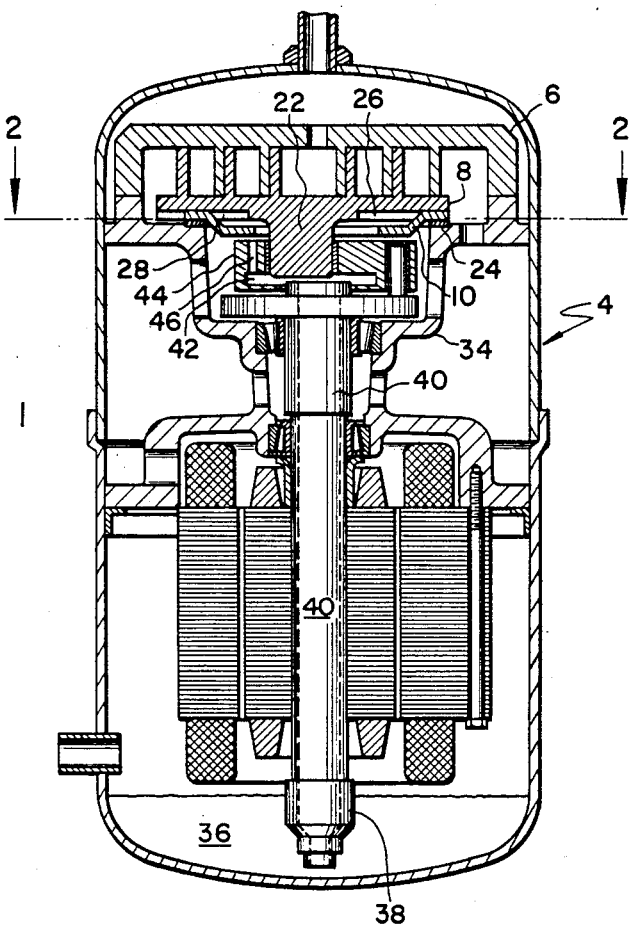
FIG. 1 shows a cutaway view of the scroll machine with the improved "Oldham coupling" having two tabs above and two tabs below the thrust bearing.

Illustrated in FIG. 1 is a scroll compressor incorporating the subject invention, generally denoted by numeral 4. As in many other scroll compressors, two parallel, intermeshed scroll elements 6 and 8 are driven to orbit relative to each other in a fixed angular relationship. In compressor 4, this fixed angular relationship is maintained by the subject invention which is a novel variation of an "Oldham coupling." This anti-rotation coupling 10 is shown in FIG. 3.

Coupling 10 includes an oblong ring 12 having substantially flat faces joined by inner and outer circumferential edges with four spaced apart tabs 14, 16, 18, and 20 extending outwardly from its perimeter (outer circumferential edge) at 90° intervals. This simple design facilitates manufacture of the coupling as a unitary piece, not requiring assembly or fabrication of component parts. For example, it can be blanked and formed from sheet metal in a single progressive die operation. In addition, since coupling 10 is relatively thin, the material cost and space required within compressor 4 is minimal.

Figure 2:
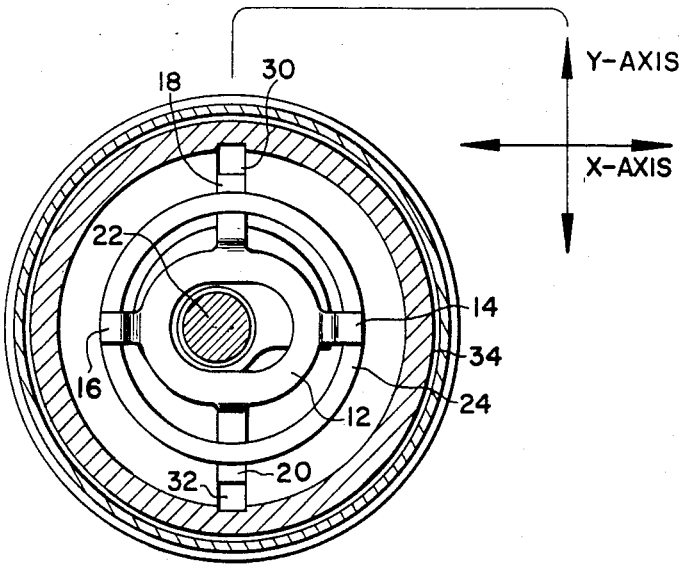
FIG. 2 shows a cross-sectional view of the improved coupling lying below the scroll plates.

In the first embodiment shown in FIG. 2, coupling 10 isdisposed aroudn drive pin 22 which extends from the bottom faceof orbiting scroll element 8. Coupling 10 is disposed directly below and generally parallel to orbiting scroll element 8. Referring to FIGS. 1 and 2, two parallel tabs 14 and 16, extending from opposite sides of ring 12 and adjacent thrust bearing 24 are bent upwardly to slidingly engage slots 26 and 28 which are dispsoed in the bottom face of orbiting scroll element 8. This sliding engagement allows orbiting scroll element 8 to move in one direction relative to coupling 10 and prevents it form rotating with respect to the coupling. Two other tabs 18 and 20 are perpendicular to the first two tabs and are bent downwardly to extend underneath thrust bearing 24, slidingly engaging slots 30 and 32. Alternatively, tabs 18 and 20 may be co-planar with ring 12, i.e., not downwardly offset, if ring 12 clears thrust bearing 24. These slots are disposed in a stationary portion of compressor 4 such as frame 34. As illustrated in FIG. 1, tabs 30 and 32 are longer than the first two tabs because, they are dispsoed on the shorter axis of oblong ring 12 and msut extend further to remain slidingly engaged in their respective slots 30 and 32. The sliding engagement of tabs 18 and 20 with slots 30 and 32 in frame 34 prevents coupling 10 from rotating but allows coupling 10 to move along the Y-axis. Therefore, drive pin 22 orbits in a circulr path within ring 12, as coupling 10 moves along the X-axis sliding within slots 26 and 28, and forcing scroll element 8 along with it as it moves along the X-axis. Coupling 10 thus insures that scroll element 8 moves in fixed angular relationship relative to fixed scroll element 6.

Coupling 10 is lubricated with oil from reservoir 36. Centrifugal pump 38 moutned on the lwoer end of hollow drive shaft 40 delivers oil from reservoir 36, up through hollow drive shaft 40 and into cavity 42 which is disposed in the lower side of swing link 44. Oil received in cavity 42 is centrifugally slung outward to the perimeter of the cavity where the inlet of riser 46 is located. Riser 46, vertically disposed in swing link 44, provides a path for the oil and directs the flow towards thrust bearing 24 and coupling 10.

In the second embodiment, coupling 10′ is disposed between and extends around scroll elements 6′ and 8′ as shown in FIGS. 4 and 5. Anti-rotation coupling 10′ is similar to coupling 10 in FIG. 3 as it includes ring 12′ with four tabs 14′, 16′, 18′ and 20′ disposed around its perimeter (circumferential edges) at 90° intervals and can be blanked as a unitary piece from sheet metal. But referring to FIGS. 4 and 5, it is shown that tabs 18′ and 20′ extend inward form ring 12′ and slidingly engage slots 30′ and 32′ which are dispsoed on the top faceof orbiting scroll element 8′. Theother two tabs 14′ and 16′, extending outward from and perpendicular to the first two, slidingly engage slots 26′ and 28′ which are disposed in the outer perimeter of stationary scroll element 6′. The sliding engagement of tabs 14′, 16′, 18′ and 20′ in their respective slots 26′, 28′, 30′ and 32′ serves the same purpose as the similar arrangement described in the first embodiment.

Although the invention is described with respect to two preferred embodiments, modifications thereto will become apparent to those skilled in the art. Therefore, the scope of the invention is to be determined by reference to the claims which follow.

I claim:

1. In a scroll machien including two generally parallel scroll plates, the facing surfaces of which have attached involute wrap elements that mesh with each other, an apparatus for preventing the relative angular rotation of the scroll plates as one orbits relative to the other, said apparatus comprising a generally annular ring having a plurality of radially extending tabs integrally joined to a circumferential edge of the ring at spaced apart intervals therearound, wherein the edge of at least one of said tabs slidingly engages a slot in one of the orbiting scroll plates and the edge of at least one other of the tabs slidingly engages a slot disposed in a stationary portion of the scroll machine.

2. The apparatus of claim 1 wherein the scroll machine further includes a supporting frame, and wherein th4e one or more slots in the stationary portion of the scroll machine are disposed in said frame in a position adjacent the one or more slots in said orbiting scroll plate and wherein the longitudinal axes of the one or more slots in the supporting frame are perpendicular to the longitudinal axes of the one or more slots in the orbiting scroll plate.

3. The apparatus of claim 2 wherein the scroll machine further includes means for driving said one scroll plate in orbital motion, said driving means extending through the open center of said annular ring to connect to said one orbiting scroll plate.

4. The apparatus of claim 1 wherein the annular ring and tabs comprise a unitary piece of sheet metal.

5. The apparatus of claim 1 wherein the annular ring is generally planar and includes four tabs, the first two of which are disposed on opposite sides of the annular ring and extend out of alignment with the plane of the annular ring and wherein there are four slots, two in the orbiting scroll plate and two in the stationary portion, each tab slidingly engaging one of the slots.

6. The apparatus of claim 5 wherein the other two tabs are disposed on opposite sides of the annular ring and extend out of coplanar alignment with the annular ring, in a direction opposite that of the first two tabs.

7. The apparatus of claim 6 wherein the annular ring is oval and two tabs are parallel to its longer axis and two are parallel to its shorter axis, and wherein said two tabs that are paralell to its longer axis are shorter in length thatn the other two tabs and slidingly engage the slots in the orbiting scroll plate, while said other two tabs that are longer, slidingly engage the slots in the stationary portion of the scroll machine.

8. The apparatus of claim 1 wherein the ring is disposed between the scroll plates and around the involute wrap elements, with at least one tab slidingly engaging a slot disposed in one scroll plate and at least one other tab slidingly engaging a slot in the other scroll plate.

9. In a scroll machine including a stationary scroll plate lying generally parallel to an orbiting scroll plate, the facing surfaces of both having involute wrap elements that mesh with each other, an apparatus for preventing the relative angular rotation of the scroll plates, said apparatus comprising a generally annular ring having a plurality of integral tabs, said ring and tabs comprising a unitary piece of sheet metal, and said tabs extending in a radial direction from a circumferential edge of the ring at spaced apart intervals therearound, wherein the edge of at least one tab slidingly engages a slot in the orbiting scroll plate and the edge of at least one other tab slidingly engages a slot disposed in a stationary portion of the scroll machine.

10. The apparatus of claim 9 wherein the scroll machine further includes a supporting frame, and wherein the one or more slots in the stationary portion of the scroll machine are disposed in said frame with their longitudinal axes perpendicular to the longitudinal axes of the one or more slots in the orbiting scroll plate.

11. The apparatus of claim 10 wherein the scroll machine further includes means for driving said orbiting scroll plate in orbital motion, said driving means extending through the open center of said annular ring to connect to said orbiting scroll plate.

12. The apparatus of claim 9 wherein the annular ring is generally planar and includes four tabs, two of which are on opposite sides of the annular ring and extend out of coplanar alignment with the plane of the annular ring and wherein there are four slots, two in the orbiting scroll plate and two in the stationary portion, each tab slidingly engaging one of the slots.

13. The apparatus of claim 12 wherein the other two tabs are on opposite sides of the annular ring and extend out of coplanar alignment with the annular ring, in a direciton opposite that of the first two tabs.

14. The apparatus of claim 13 wherein the annular ring is oval with two tabs parallel to its longer axis and two tabs parallel to its shorter axis, and wherein said two tabs that are parallel to its longer axis are shorter in length than the other two tabs and slidingly engage the slots in the orbiting scroll plate, while said other two tabs that are longer, slidingly engage the slots in the stationary portion of the scroll machine.

15. The apparatus of claim 9 wherein the ring is disposed between the scroll plates and around the involute wrap elements, with at least one tab slidingly engaging a slot disposed in one scroll plate and at least one other tab slidingly engaging a slot in the other scroll plate.

16. In a scroll machien including a stationary scroll plate disposed generally parallel to an orbiting scroll plate, both plates having involute wrap elements on their facing surfaces intermeshed with eachother, an apparatus for preventing angular rotation of the scroll plates relative to each other, said apparatus comprising a generally annular ring having four integral tabs, said ring and tabs comprising a unitary piece of sheet metal, and said tabs extending in a radially outward direction at spaced apart intervals around the ring, wherein the edges of two tabs slidingly engage two slots disposed in the orbiting scroll plate and the edges of two other tabs slidingly engage two slots that are disposed in a stationary portion of the scroll machine, with at least two of said tabs at opposite ends of said annular ring extending our of coplanar alignment with said ring.

17. The apparatus of claim 16 wherein the scroll machine further includes a supporting frame, and wherein the slots in the stationary portion of the scroll machine are disposed in said frame, with the longitudinal axes of these slots substantially perpendicular to the longitudinal axes of the slots in the orbiting scroll plate.

18. The apparatus of claim 17 wherein the scroll machine further includes means for driving said one scroll plate in orbital motion, said driving means extending through the open center of said annular ring to connect to said one orbiting scroll plate.

19. The apparatus of claim 16 wherein the other two tabs are on opposite sides of the annular ring and extend outof coplanar alignment with the annular ring, in a direciton opposite that of the first two tabs.

20. The apparatus of claim 18 wherein the annular ring is oval with two tabs parallel to its longer axis and two parallel to its shorter axis, and wherein said two tabs that are parallel to its longer axis are shorter in length than the other two tabs and slidingly engage the slots in the orbiting scroll plate, while said other two tabs that are longer, slidingly engage the slots in the stationary portion of the scroll machine.

* * * * *